US005282776A

United States Patent [19]

Dalebout

[11] Patent Number: 5,282,776

[45] Date of Patent: Feb. 1, 1994

[54] UPPER BODY EXERCISER

[75] Inventor: William T. Dalebout, Logan, Utah

[73] Assignee: Proform Fitness Products, Inc., Logan, Utah

[21] Appl. No.: 13,637

[22] Filed: Feb. 4, 1993

Related U.S. Application Data

[63] Continuation-in-part of Ser. No. 954,299, Sep. 30, 1992.

[51] Int. Cl.[5] ..... A63B 21/015

[52] U.S. Cl. ..... 482/118; 482/114; 482/52; 482/53; 482/54

[58] Field of Search ..... 482/114, 115, 118, 52, 482/53, 54, 62

[56] References Cited

U.S. PATENT DOCUMENTS

| | | | |
|---|---|---|---|
| 3,345,067 | 10/1967 | Smith . | |
| 3,659,845 | 5/1972 | Quinton | 482/54 |
| 4,618,139 | 10/1986 | Haaheim . | |
| 4,804,178 | 2/1989 | Friedebach . | |
| 4,838,544 | 6/1989 | Sasakawa . | |
| 4,971,316 | 11/1990 | Dalebout . | |
| 5,000,442 | 3/1991 | Dalebout . | |
| 5,058,882 | 10/1991 | Dalebout et al. | 482/53 |
| 5,110,117 | 5/1992 | Fisher et al. | 482/54 |
| 5,145,481 | 9/1992 | Friedebach | 482/118 |
| 5,149,312 | 9/1992 | Croft et al. . | |
| 5,181,894 | 1/1993 | Shieng et al. . | |
| 5,207,622 | 5/1993 | Wilkinson et al. | 482/54 |

*Primary Examiner*—Richard J. Apley
*Assistant Examiner*—Lynne A. Reichard
*Attorney, Agent, or Firm*—Trask, Britt & Rossa

[57] ABSTRACT

An upper body exercise device having a support structure including an upstanding stub-post mounted to an extending upwardly from said stub-post and further comprising a central housing carried by the support post and having spacers at opposite ends of the central housing so that resistance pads on the spacers act against surfaces of the central housing as arms carried by the spacers are manipulated back and forth and with the entire assembly held together by a carriage bolt and nut extending through plate members fixed to the central housing and with the underhead of the carriage bolt gripped intermediate its length by a plate member to prevent rotational movement of the carriage bolt.

14 Claims, 2 Drawing Sheets

UPPER BODY EXERCISER

This is a continuation-in-part application of application Ser. No. 07/954,299 which was filed on Sep. 30, 1992.

BACKGROUND OF THE INVENTION

1. Field

This invention relates to upper body exercise devices and is particularly related to upper body exercise devices adaptable for use either individually or concurrently with use of other devices exercising other body areas.

2. State of the Art

Pivoted arm structures with resistance to a pivoting action have long been used to exercise the upper body. The known pivoted arm structures generally include handle means to be grasped by a user, arms to which the handles are connected at one end and means joining the other end of the arms to a support structure. The arms may be mounted to pivot separately or together. Upper body pivoting arms may be found in rowing machines, stepping exercise machines and cross country ski exercise machines.

While upper body exercisers may be suitable for use in exercising the upper body, there remains a need for such a device that can be made durably, inexpensively, and that will provide adjustable resistance to pivoting of arms by a user grasping handles attached to such arms.

SUMMARY OF THE INVENTION

An exercise device includes an upper body exercise structure mounted to a support structure. As so configured the exercise device may be used as a stand alone exercise device or in combination with other exercise structures. That is the exercise device can readily be mounted to a support structure having another exercise device thereon so that both exercise devices can be separately or simultaneously used to exercise.

The exerciser of the invention includes a pair of arms (also called handles), each pivotally mounted on a common shaft, to be pivoted by a user. The arms handles are each mounted in a spacer through which a long carriage bolt is passed. The spacers are separated by a central housing, opposite ends of which are smooth, unpainted material. Resistance pads on the ends of the spacers cooperate with the end surfaces of the central housing to provide resistance to pivoting of the arms.

The spacers are each mounted on support legs of an L-shaped bracket. Each bracket has a support leg, welded or otherwise affixed to the central housing and another leg with a hole through which the carriage bolt is inserted. Preferably the spacers fit snugly between the central housing and the other legs of the L-shaped brackets.

The hole through one L-shaped bracket is made square and just large enough to receive and grip the tapered square underhead of the carriage bolt intermediate the length of the underhead when the carriage bolt is inserted through a decorative cap, the one L-shaped bracket, a first spacer, a support post, a second spacer, and another L-shaped bracket, and has a nut that is secured within a decorative cap, threaded thereon.

The spacers rotate about the carriage bolt with movement of the arms and friction pads on the spacers are adjustably held against bare surfaces on the support post by the extent to which the nut is threaded onto the carriage bolt.

BRIEF DESCRIPTION OF THE DRAWINGS

In the drawings which illustrate what is presently regarded as preferred embodiments.

DETAILED DESCRIPTION OF THE PREFERRED EMBODIMENT

Figure 1:
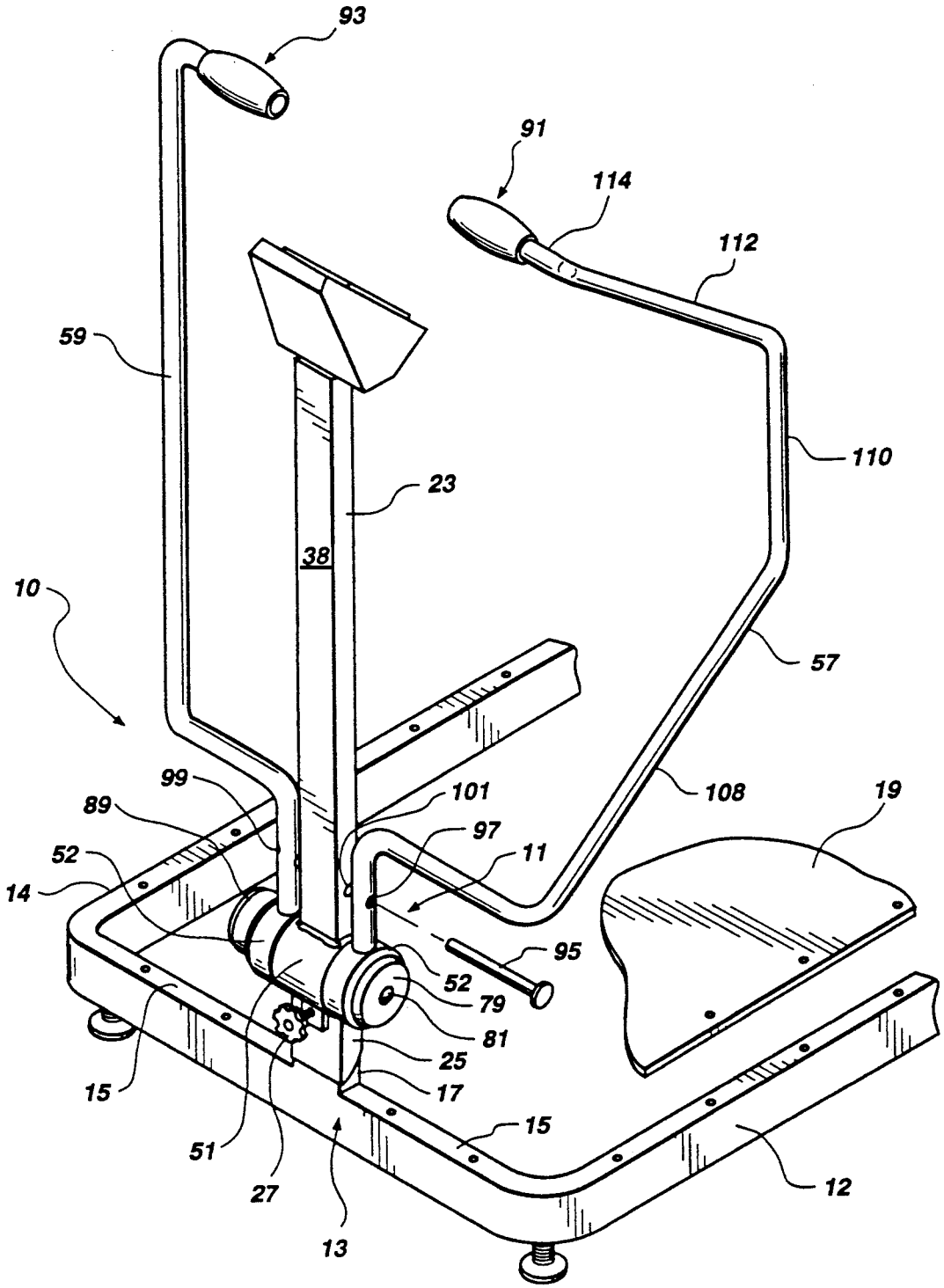
FIG. 1 is a partial perspective view of the upper body exerciser of the invention in association with a support base.
Figure 2:
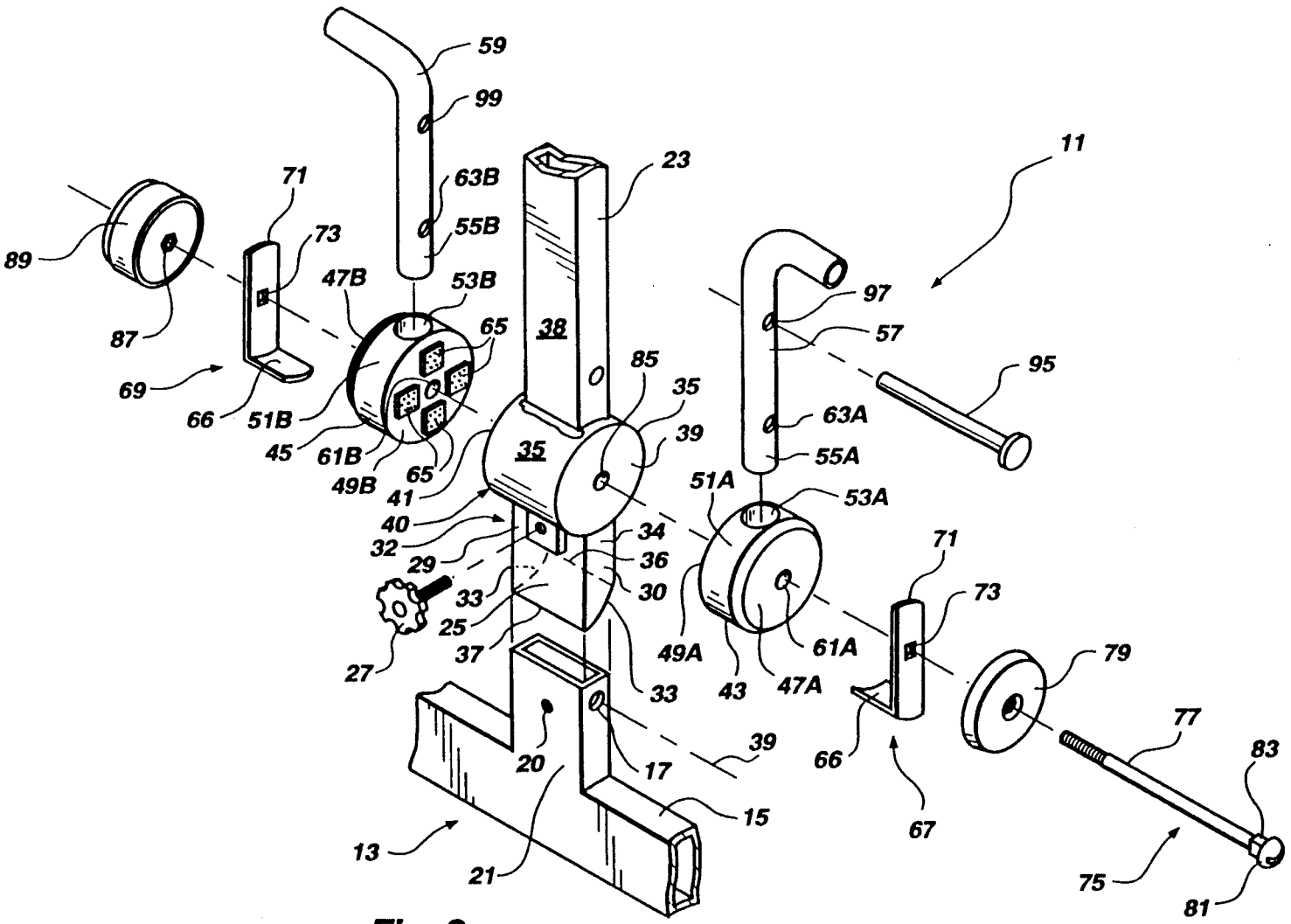
FIG. 2 is an exploded perspective view of the upper body exerciser of FIG. 1.

FIGS. 1 and 2 show the upper body exerciser 10 to include a resistance means such as mechanism 11. The upper body exerciser is connected to support structure 13 which may be part of an exercise machine such as a stepping exercise machine. The machine is described and illustrated in U.S. Pat. No. 5,062,627, as well, a wide variety of other stepping exercise machines may be suitable. In addition the exerciser 10 may be a stand alone device.

The support structure 13 of FIGS. 1 and 2 has a header beam 15 with a left rail 12 and a right rail 14 extending therefrom. The header beam 15 and left and right rails 12 and 14 may be part of the frame of, for example, a treadmill, stepper or other separate exercise machine in which a plate or platform 19 may be secured to support a user thereon.

Trunnion 17 extends, upwardly from the header beam 15 and has a threaded hole 20 in one face 21 thereof. A support post 23 has a lower end 25 that telescopes over the trunnion 17. A bolt 27 is threaded through the front surface 29 of lower end 25. When the end 25 is telescoped over trunnion 17, bolt 27 may be threaded into hole 19 to lock the support post 23 in an upright position to the trunnion 17. Sides 30 and 32 of the lower end 25 have curved edges 33; and the rear surface 34 has a lower edge 36 higher than the lower edge 37 of the front surface 29. The support post 23 can thereby easily pivot about axis 39 to a lowered position when bolt 27 is removed from hole 19, as will be further explained.

Support post 23 extends through the wall 35 of a cylindrical central housing 40 and is welded or otherwise affixed thereto. The opposite ends 39 and 41 of the central housing are flat, unpainted surfaces.

Spacers 43 and 45 are respectively aligned with the central housing 40 at opposite ends 39 and 41. Each spacer 43 and 45 is of general cylindrical configuration. Each has spaced apart ends 47A and 47B and 49A and 49B interconnected by a side wall 51. A bore 53A and 53B extends through the sidewalls 51A and 51B into each spacer 43 and 45 to snugly receive an end 55A and 55B of one of a pair of handles 57 and 59.

An aperture 61A and 61B is provided through the spacers 43 and 45 to extend from ends 47A and 47B through end 49A and 49B. Similar aligned apertures 63A and 63B are provided through the ends 55A and 55B of each handle 57 and 59 to hold the handles 57 and 59 to the spacers 43 and 45 when the handles 57 and 59 are inserted into the bores 53A and 53B.

Resistance pads 65 are bonded or otherwise affixed to each face 49A and 49B of each spacer 43 and 45 and preferably are equally spaced around the apertures 61A and 61B. As shown, four such resistance pads 65 are provided on each face 49. The spacers 43 and 45 respectively rest on a leg 66 of an L-shaped bracket 67 or 69 and are then positioned between the other leg 71 of a bracket 67 or 69 and the central housing 37. The legs 66 of the brackets 67 and 69 have their ends remote from the 71 welded or otherwise affixed to the central housing 40. Holes 73 are provided through the legs 71 of the brackets 67 and 69, to be aligned with the bore holes 61 and 63. At least the hole 73 of bracket 67 is square, as will be further explained. It is not necessary that the hole 73 of bracket 69 be square, but it may be, if desirable to make the brackets 67 and 69 identical as a means of reducing costs of construction.

A carriage bolt 75 holds the entire assembly together and serves as a pivot shaft for the spacers 43 and 45 and the handles 57 and 59 inserted therein. The carriage bolt shank 77 is inserted through a decorative cap member 79, with the bolt head 81 recessed into the cap member. The shank 77 passes through hole 73 of leg 74 of bracket 67 and the underhead 83 of the carriage bolt is inserted into the hole 73. Hole 73 is sized to grip the underhead 83 intermediate the length of the underhead so that the head 8 does not at any time engage leg 71. The shank 77 is inserted through bore hole 61 of spacer 43 a bore hole 85 through the central housing 37, bore hole 61 through spacer 45, and hole 73 of L-shaped plate 69 to have a nut 87, fitted within a decorative cap 89, threaded thereon.

The threading of nut 87 onto the end of the shank of carriage bolt 75 holds the assembly of caps 79, 89, L-shaped plates which form brackets 67, 69, spacers 43, 45 and central housing 40 together, with the ends 49 of the spacers and the friction pads 65 thereon in contact with the bare end surfaces 39 and 41 of the central housing 37.

Turning of nut 87 more tightly onto bolt 75 bends the legs 71 towards one another and forces the resistance pads 65 on the spacers 43 and 45 into greater frictional engagement with the ends 39 and 41 of the central housing 40.

Because the square hole 73 into which fits the tapered underhead 83 of square cross-sectional configuration, grips the underhead 83 intermediate its length, the assembly is held together without the need for thrust bearings or other structures to prevent disassembly during use of the exercise device. Since the underhead 83 is at all times pulled tightly into the square hole 73, there is no possibility for a movement of the underhead 83 relative to the leg 71 of bracket 79. Consequently, there is no possibility of the bolt 75 turning with respect to nut 87 and loosening of the nut. It should be noted that if the underhead were to be fully inserted into the square hole 73, with the head 81 in engagement with the leg 71, the hole 73, of necessity, would be at least a smallest amount larger than the underhead and some movement of the bolt relative to the leg 71 would be possible. The permitted movement may be small but such movement, on a separated basis loosen the nut 87, and allow the exercise device to disassemble. Therefore, it is important that the square hole 73 be sized to grip the underhead 83 intermediate the length of the underhead 83 and that hole 73 not permit pulling of the head 81 into engagement with the leg 71.

As shown best in FIG. 1, the arms 57 and 59 each extend upwardly, outwardly and upwardly before being inturned to form handles 91 and 93 to be grasped by a user of the exercise device 11.

The handles 91 and 93 are pushed forwardly and pulled back, preferably in an alternating or reciprocating sequence, during exercise of the upper body of the user. As has been previously noted, the resistance to such pushing and pulling is set by the extent to which nut 87 is turned onto bolt 75 and the resistance to movement of both arms 57, 59 can be adjusted, and will be the same according to the extent to which nut 87 is threaded onto bolt 75.

A locking pin 95 is adapted to be inserted through aligned holes 97 and 99 through the arms 57 and 59 and through a hole 101 through the lower end 25 of the support post 23.

Bolt 27 is removed from hole 19 to allow the arms 57 and 58, support post 23 and any control panel (not shown) carried thereby to be removed as a unit form the stub-post called trunnion 17 or pivoted on the axis 39 and the curved edges 33 to a lowered storage position. It will be apparent that a pivot pin (not shown) can be provided through the lower end 25 of post 23 and the stub-post or trunnion 17, if desired.

In reference to FIG. 1, the handles 57 and 59 are here shown with apertures 97 and 99 framed therein. A corresponding aperture 101 is formed in the support post 23. With the handles 57 and 59 positioned as shown in FIG. 1, pin 95 may be inserted to lock the handles 57 and 59 in an at-rest position.

In FIG. 1, the handle 57 is shown formed of a rearwardly extending section 108, an upwardly extending section 110 and a forwardly extending section 112 with the grip section 114 extending inwardly when secured by pin 93. The handle 57 forms a portion of a safety rail or cage-like structure for the user. With handle 59 formed to mirror handle 59, opposite rails will form the cage-like structure.

In use, the structure of FIG. 1 may be used separately with the platform 19 to perform exercises. Alternately, it may be adapted to a treadmill structure such as the post of the treadmill illustrated and described in U.S. Pat. No. 5,102,380 (Jacobson, et al.). It may also be adapted to the frame structure of a stepping exercise machine or even a cross country ski exercise machine.

It may also be noted that the trunnion 17 and post 23 are here shown centrally positioned on the frame 15. However, it should be understood that the shape of the handles 57 and 59 may be varied so the post may be positioned as desired relative to the frame and the user.

Reference herein to a specific embodiment or example is not intended to limit the scope of the appended claims.

I claim:

1. An exercise machine comprising: a frame for positioning on a support surface;

an elongate support post extending upwardly from said frame and attached at a lower end to said frame;

support means connected to said frame for supporting a user;

a pair of handles each rotatably attached to said support post and spaced upwardly away from said lower end, said pair of handles being supported by said support post and being sized for grasping and movement by a user standing on said support means;

resistance means interconnected between said support post and said pair of handles to resist movement thereof by a user.

2. The exercise machine of claim 1 further including locking means for locking each of said pair of handles to said support post.

3. An exercise machine comprising:

a frame for positioning on a support surface;
a support post having a lower end attached to and extending upwardly from said frame;
support means connected to said frame for supporting a user;
a pair of handles each rotatably attached to said support post, said pair of handles being supported by said support post and being sized for grasping and movement by a user standing on said support means;
resistance means interconnected between said support post and said pair of handles to resist movement thereof by a user;
locking means for locking each of said pair of handles to said support post; and
said pair of handles formed with a portion to extend rearwardly when locked to said support post in an upright position.

4. An exercise machine comprising:
a frame for positioning on a support surface;
a support post having a lower end attached to and extending upwardly from said frame;
a support means connected to said frame for supporting a user;
a pair of handles each rotatably attached to said support post, said pair of handles being supported by said support post and being sized for grasping and movement by a user standing on said support means;
resistance means interconnected between said support post and said pair of handles to resist movement thereof by a user;
locking means for locking each of said pair of handles to said support post; and
each handle of said pair of handles formed with a portion to extend rearwardly when locked to said support post in an upright position to form a structure extending to a position proximate a side of said frame.

5. An exercise machine comprising:
a frame for positioning on a support surface;
a support post having a lower end attached to and extending upwardly from said frame;
a support means connected to said frame for supporting a user;
a pair of handles each rotatably attached to said support post and sized for grasping and movement by a user standing on said support means;
resistance means interconnected between said support post and said pair of handles to resist movement thereof by a user, said resistance means having:
a central housing member fixed to and carried by said support post, said central housing having opposite ends with resistance surfaces thereon,
a pair of spacers each having at least one resistance pad on one face thereof and a handle projecting from said spacer to be grasped by a user of said exercise device,
means fixed to said central housing and including a plate for engaging each said spacer at a face thereof opposed to said resistance pad and at least one said plate having an aperture therethrough;
a carriage bolt having a head, an underhead and a shank with a threaded end thereon, said underhead having a cross section formed to register with said aperture and being tapered from said head to said shank, said bolt being inserted through said aperture until the edges of said aperture grip said underhead intermediate the length of the underhead and through holes in said spacers when the spacers are each positioned with said resistance pad in engagement with said resistance surface, through a hole through said central housing and through a hole in said other plate; and
nut means adjustably threaded onto the threaded end of said shank to press said resistance pads against said resistance surfaces to thereby resist rotation of said handles and said spacers relative to said central housing.

6. A treadmill comprising:
a frame for positioning on a support surface;
an elongate support member attached at a lower end to said frame to extend upwardly away therefrom;
tread means connected to said frame for supporting a user thereon;
a pair of handles each rotatably attached to said elongate support member at a position spaced upwardly away from said lower end, each being supported by said elongate support member and each being sized for grasping and movement by a user standing on said tread means; and
resistance means interconnected between said support member and said pair of handles to resist movement thereof by a user.

7. The treadmill of claim 6 further comprising:
a trunnion attached to said frame to extend upwardly therefrom;
said support member rotatably connected to said trunnion to rotate between an upright position and a stored position spaced away from said upright position toward said frame
securing means for rigidly securing said support member to said trunnion in said upright position.

8. The treadmill of claim 6 wherein said frame includes a trunnion and said support post is connected to said trunnion.

9. The treadmill of claim 8 wherein said support post is rotatably connected to said trunnion to rotate between an upright position and a stored position spaced away form said upright position toward said frame, and including securing means to rigidly secure said support post to said trunnion in said upright position.

10. An exercise machine comprising:
a frame for positioning on a support surface;
a support post having a lower end attached to and extending upwardly from said frame;
support means connected to said frame for supporting a user;
a pair of handles each rotatably connected to said support post and sized for grasping and movement by a user;
resistance means interconnected between said support post and said pair of handles to resist movement thereof by a user;
locking means for locking each of said pair of handles to said support post; and
each handle of said pair of handles including a position extending rearwardly when locked to said support post in an upright position.

11. An exercise machine comprising:
a frame for positioning on a support surface;
a support post attached at a lower end to and extending upwardly from said frame;
a support means connected to said frame for supporting a user;

a pair of handles each rotatably connected to said support post and sized for grasping and movement by a user standing on said support means;

resistance means interconnected between said support post and said pair of handles to resist movement thereof by a user; and locking means for locking each of said pair of handles to said support post; and each handle of said pair of handles formed with a portion to extend rearwardly and outwardly when locked to said support post in an upright position.

12. An exercise machine comprising:

a frame for positioning on a support surface;

a support post extending upwardly from said frame;

support means connected to said frame for supporting a user;

a pair of handles rotatably connected at said support post and sized for grasping and movement by a user;

resistance means interconnected between said support post and said pair of handles to resist movement thereof by a user;

locking means for locking each of said pair of handles to said support post; and each handle of said pair of handles including a portion extending rearwardly and outwardly to form a side member positioned above said frame when locked to said support post for grasping by a user.

13. An exercise machine comprising:

a frame for positioning on a support surface;

a support post attached to extend upwardly from said frame;

a support means connected to said frame for supporting a user;

a pair of handles rotatably connected proximate said support post and sized for grasping and movement by a u ser standing on said support means;

resistance means interconnected between said support post and said pair of handles to resist movement by a user standing on said support means;

locking means for locking each of said pair of handles to said support post; and each handle of said pair of handles formed with a portion to extend rearwardly and outwardly beside a user when standing on said support means for grasping by a user when said pair of handles is locked to said support post in an upright position.

14. A treadmill comprising:

a frame for positioning on a support surface;

a support post having a lower end attached to and extending upwardly from said frame;

support means connected to said frame for supporting a user;

a pair of handles rotatably connected to said support post and sized for grasping and movement by a user;

resistance means interconnected between said support post and said pair of handles to resist movement thereof by a user, said resistance means including:

a central housing fixed to said support and having opposite ends with resistance surfaces thereon;

a pair of spacers each having at least one resistance pad on a face thereof and a handle projecting from said spacer for grasping by a user during exercises;

means fixed to said central housing and including at least one plate for engaging said resistance pad of each said spacer;

a carriage bolt formed to register with an aperture in one of said at least one plate and to extend through said pair of spacers; and a nut adjustably threaded onto an end of said carriage bolt for forcing said resistance pads against said resistance surfaces to thereby resist rotation of said handles relative to said central housing.

* * * * *